US008567560B1

(12) United States Patent
Rodriguez

(10) Patent No.: US 8,567,560 B1
(45) Date of Patent: Oct. 29, 2013

(54) PORTABLE WORK PLATFORM

(76) Inventor: Joe F. Rodriguez, La Porte, TX (US)

( * ) Notice: Subject to any disclaimer, the term of this patent is extended or adjusted under 35 U.S.C. 154(b) by 184 days.

(21) Appl. No.: 12/946,958

(22) Filed: Nov. 16, 2010

(51) Int. Cl.
*E04G 1/36* (2006.01)

(52) U.S. Cl.
USPC ..... 182/223

(58) Field of Classification Search
USPC ..... 182/230, 45, 223, 222, 33; 211/10, 175; 404/35; 14/2.4; 403/109.3; 52/483.1; 108/47, 48, 42, 115, 132, 27
See application file for complete search history.

(56) References Cited

U.S. PATENT DOCUMENTS

| | | | | | |
|---|---|---|---|---|---|
| 3,282,378 | A | * | 11/1966 | Pierce | 182/113 |
| 3,556,254 | A | * | 1/1971 | Lambert et al. | 182/223 |
| 3,648,628 | A | * | 3/1972 | Davis | 108/33 |
| 4,313,385 | A | * | 2/1982 | Fitzgerald | 108/38 |
| 5,029,671 | A | * | 7/1991 | Larson | 182/155 |
| 5,067,589 | A | * | 11/1991 | Bartnicki | 182/223 |
| 5,085,154 | A | | 2/1992 | Merl | |
| 5,170,720 | A | * | 12/1992 | Scheurer | 108/44 |
| 5,239,790 | A | * | 8/1993 | Fetzer | 52/36.4 |
| 5,913,782 | A | * | 6/1999 | Monaco et al. | 52/126.1 |
| 6,267,201 | B1 | | 7/2001 | Cunniffe | |
| 7,086,500 | B2 | * | 8/2006 | Moss et al. | 182/119 |
| 7,290,746 | B1 | * | 11/2007 | Macias et al. | 248/311.2 |
| 2004/0004420 | A1 | | 1/2004 | Pine et al. | |
| 2005/0016098 | A1 | * | 1/2005 | Hahn | 52/384 |
| 2005/0263030 | A1 | | 12/2005 | Karpati | |
| 2005/0279260 | A1 | * | 12/2005 | Stanford et al. | 108/115 |
| 2007/0028550 | A1 | | 2/2007 | Clapper | |
| 2009/0266010 | A1 | * | 10/2009 | Lomske et al. | 52/173.1 |

* cited by examiner

*Primary Examiner* — James O Hansen
*Assistant Examiner* — Kristine Florio
(74) *Attorney, Agent, or Firm* — Montgomery Patent & Design; Robert C. Montgomery

(57) ABSTRACT

A portable work platform comprises a pair of length adjustable platforms, a lock assembly, and a plurality of storage compartments. The platforms comprise a flat surface constructed of a lightweight, durable material. The lock assembly comprises a lock mechanism to secure the platforms in a desired length. The lock mechanism allows a user to selectively extend the length of the platforms and securely lock them in place. The plurality of storage compartments comprises a plurality of recessed openings which are capable of housing small tools.

15 Claims, 8 Drawing Sheets

PORTABLE WORK PLATFORM

RELATED APPLICATIONS

Not Applicable.

FIELD OF THE INVENTION

The present invention relates generally to attics, and in particular, to a portable adjustable platform for traversing confined, floorless spaces such as attics.

BACKGROUND OF THE INVENTION

Attic areas and similar building features are commonly utilized as a means of out of the way storage for infrequently used personal possessions. Such areas are rarely traversed and are generally not suitable as common living space. These features make them perfect for storage of bulky and infrequently utilized items.

While such areas provide a large amount of storage space, the same facets that make them unsuitable as living space also make it difficult to traverse and work in such spaces. Often, attic spaces and the like are constructed of various wooden joists and similarly narrow standing space. Moving about becomes precarious and uncomfortable. These factors are particularly aggravated during extended periods of work and movement in the confined space, such as during construction of these areas or other work projects undertaken in these areas.

One (1) common method of traversing these spaces includes laying a flat, long structure such as a plank of wood across the joints. While this provides a slightly wider strip of flat surface for standing and traversing the area, such structures are generally dangerous to adjust, unstable, of less-than-desirable dimensions, and only suitable for particular lengths, angles, and locations of use. Accordingly, there exists a need for a means by which to traverse floorless, confined areas such as attics without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to traverse floorless, confined areas such as attics in a safe, stable manner which is applicable to locations of varying size, spacing, shape, width, and orientation. Thus, the object of the present invention is to solve the aforementioned disadvantages and provide for this need.

To achieve the above objectives, it is an object of the present invention to provide a means for a user to safely kneel, sit, or lie down during work in confined spaces such as an attic or crawl space. The apparatus comprises a portable work platform further comprising an inner platform and an outer platform.

Another object of the present invention is to provide a means to view the apparatus and surrounding area in low light conditions by comprising a phosphorescent additive integral to the inner and outer platforms.

Yet still another object of the present invention is to provide a selectable length adjusting means to the apparatus. The inner platform comprises a solid body which is slidingly received by a hollow portion of the outer platform.

Yet still another object of the present invention is to provide a means to secure the apparatus at a desired length with a lock assembly which allows the user to selectively fix the inner platform in place with respect to the outer platform.

Yet still another object of the present invention is to provide a storage means for various objects. The apparatus comprises a plurality of recessed rectangular trays and a plurality of circular recesses suitable for receiving small objects such as tools, cups, and bolts.

Yet still another object of the present invention is to facilitate transport of the apparatus by comprising a pair of handles located on opposing side surfaces of the inner platform.

Yet still another object of the present invention is to provide a means to stabilize the apparatus in a horizontal orientation while upon a ceiling joist. The apparatus further comprises a support assembly located on a bottom surface of the inner platform and a support assembly located on a bottom surface of the outer platform. Each support assembly comprises a stability bracket which is deployable downward from the apparatus in order to position against a ceiling joist and prohibit the apparatus from moving horizontal during use.

Yet still another object of the present invention is to provide a method of utilizing the device that provides a unique means of acquiring an instance of the apparatus, transporting the apparatus to a desired work area, placing the apparatus across a plurality of ceiling joists or similar structures, selectively adjusting the length of the apparatus, utilizing the support assemblies to secure the apparatus in its position, storing a desired plurality of objects within the recessed rectangular trays and circular recesses, selectively releasing, moving, and adjusting the apparatus to a different location, position or orientation, and transporting the apparatus with the handles.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | portable work platform |
| 15 | user |
| 16 | ceiling joist |
| 20 | inner platform |
| 21 | handle |
| 30 | outer platform |
| 32 | outer platform interior portion |
| 35 | first compartment |
| 36 | second compartment |
| 40 | lock assembly |
| 41 | spring-loaded button |
| 42 | aperture |
| 43 | spring |
| 50 | support assembly |
| 51 | stability bracket |
| 52 | protrusion |
| 53 | detent |
| 54 | recess |
| 55 | securing feature |
| 56 | finger relief |

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
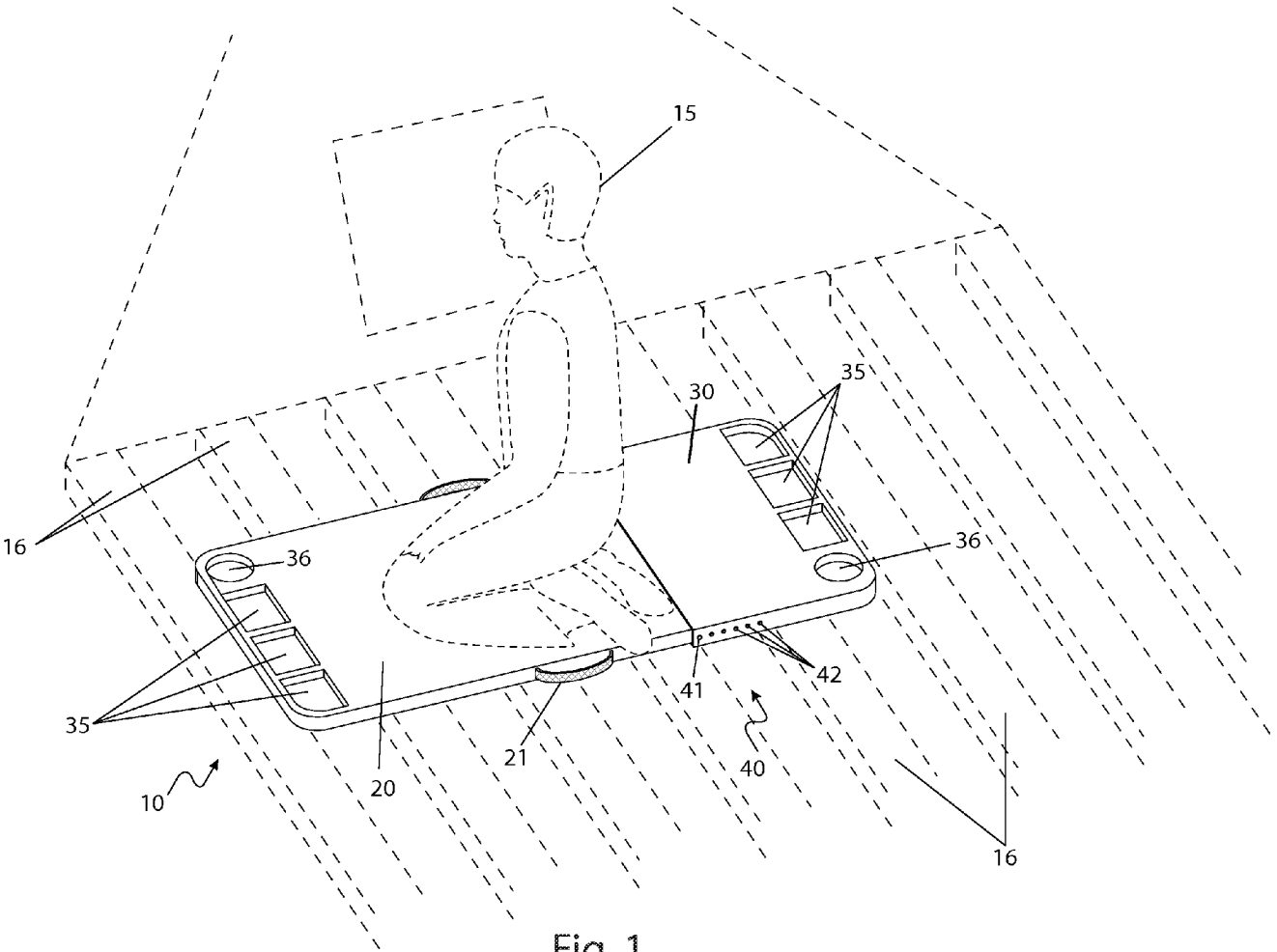
FIG. 1 is an environmental view of a portable work platform 10, according to a preferred embodiment of the present invention.

The present invention describes a portable work platform (herein described as the "apparatus") 10, which provides a means for a durable low-profile rectangular work stand for a user 15 to kneel, sit, or lie down on during work in confined spaces such as an attic or crawl space. Referring now to FIG. 1, an environmental view of the apparatus 10, according to the preferred embodiment of the present invention, is disclosed. The apparatus 10 is preferably positioned superjacent to a plurality of ceiling joist 16 to enable the user 15 to work safely and comfortably. The apparatus 10 comprises an inner platform 20 and an outer platform 30 which provide an area for the user to work upon. The apparatus 10 is adjustable via a lock assembly 40 which enables said apparatus 10 to be adjusted from twenty-four (24) inches to thirty-six (36) inches in length. The apparatus 10 is stabilized horizontally via a pair of stability brackets 50.

Figure 2:
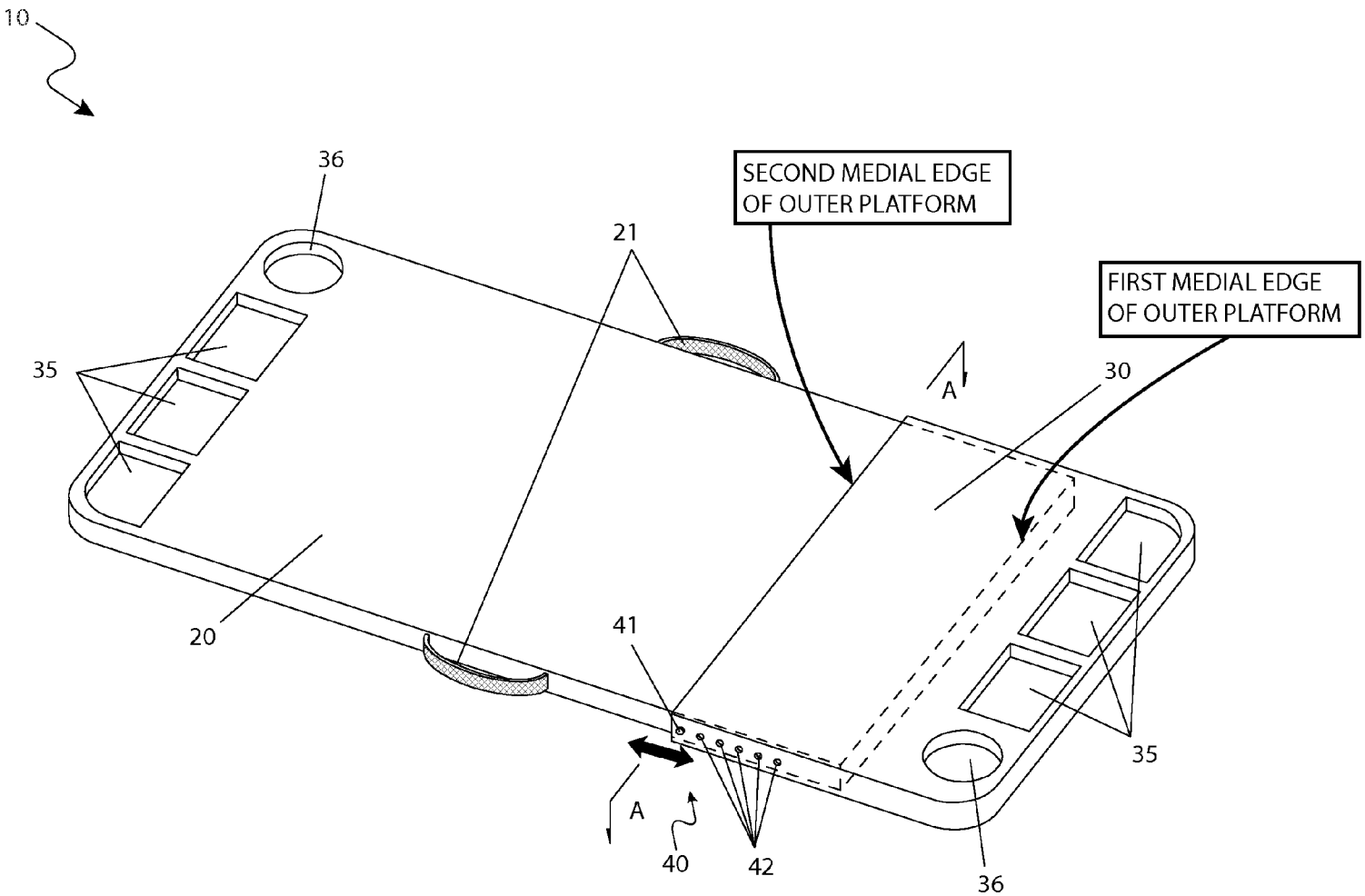
FIG. 2 is a perspective view of the portable work platform 10, according to a preferred embodiment of the present invention.
Figure 3:
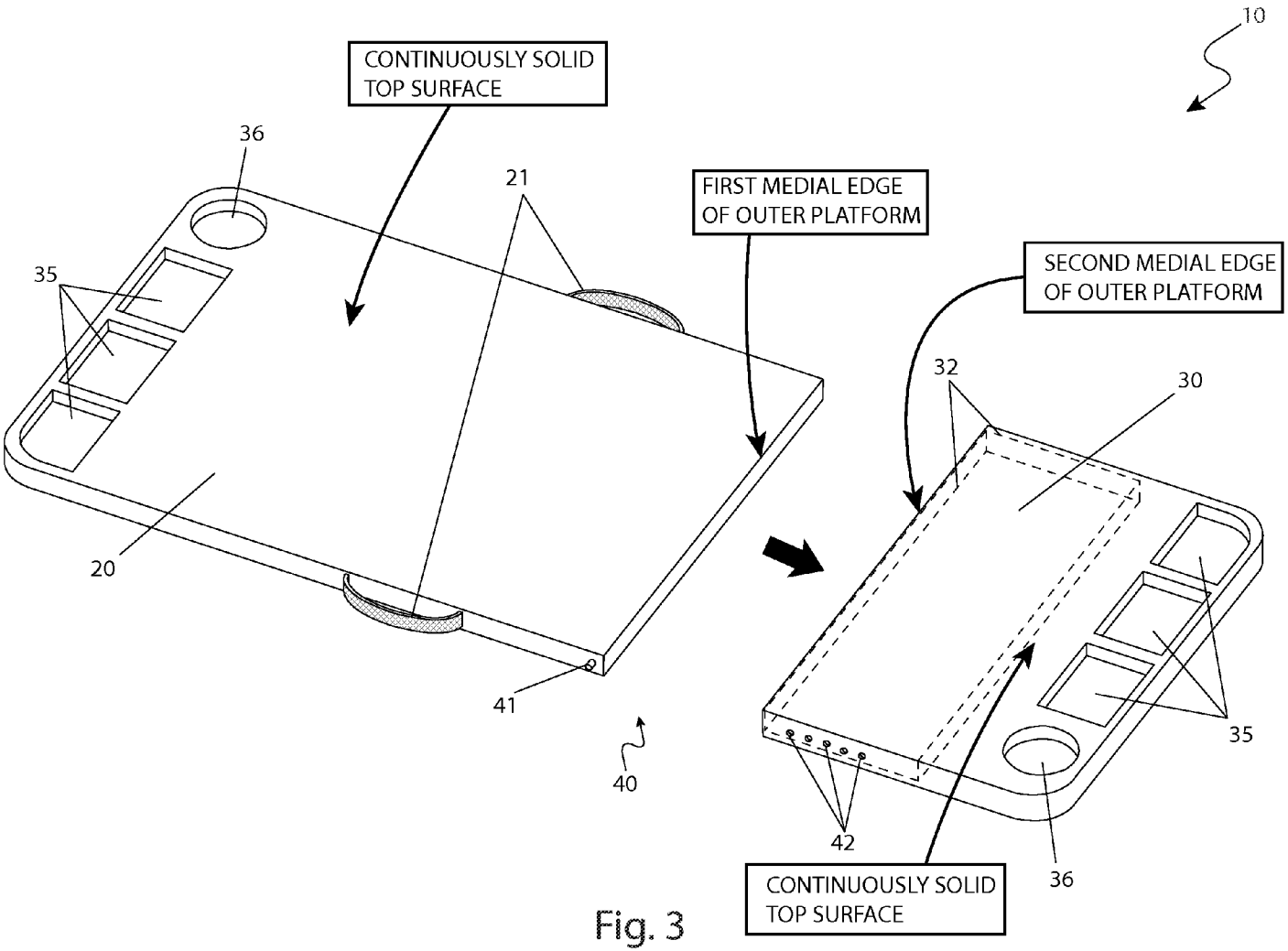
FIG. 3 is an exploded perspective view of the portable work platform 10, according to a preferred embodiment of the present invention.
Figure 4:
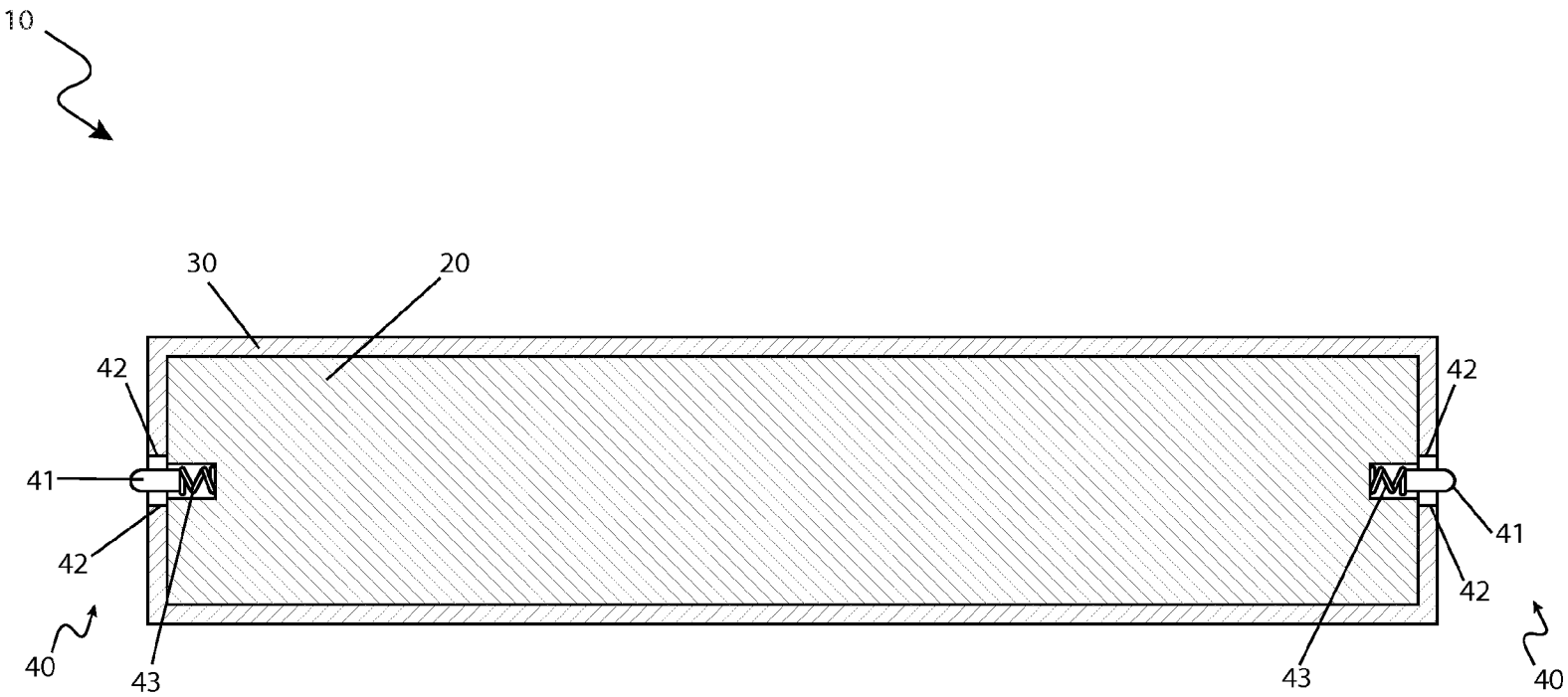
FIG. 4 is a section view of the portable work platform taken along line A-A (see FIG. 2) 10, according to a preferred embodiment of the present invention.

Referring now to FIG. 2, a perspective view of the apparatus 10, FIG. 3, an exploded perspective view of the apparatus 10, and FIG. 4, a section view of the apparatus 10 taken along line A-A (see FIG. 2), according to the preferred embodiment of the present invention, are disclosed. The apparatus 10 comprises a rectangular inner platform 20 and a rectangular outer platform 30 which are preferably fabricated from a heavy duty plastic material comprising enhanced features such as a phosphorescent additive introduced into the plastic material which provides a means to view said apparatus 10 in low lighting situations or areas. The inner platform 20 is preferably a solid body which provides stability to the apparatus 10 and the outer platform 30 is hollow so as to receive said inner platform 20 which provide additional structural stability to said apparatus 10. The platforms 20, 30 also provide a selectable length adjusting means to said apparatus 10. The inner platform 20 slidably engages an outer platform interior portion 32 and is locked into a desired position via a lock assembly 40 (see herein below). The outer platform 30 measures approximately ten (10) inches in width and three (3) inches in height and the inner platform 20 is slightly smaller than said outer platform 20 to enable positioning within.

Each platform 20, 30 comprise a plurality of first compartments 35 and a second compartment 36 which provide a storage means to the apparatus 10. The first compartments 35 are located parallel to a perimeter edge of each platform 20, 30 in a linear pattern and comprise a recessed rectangular tray for placement of tools, nut and bolts, or other similar materials. The second compartment 36 is located parallel to the first compartments 35 and comprises a circular recess which provides a means to position cups or the like within. The compartments 35, 36 are preferably integrally molded into each platform 20, 30.

The inner platform 20 comprises a pair of handles 21 which enable the user 15 to transport the apparatus 10 to a desired location. The handles 21 are located on opposing side surfaces of the inner platform 20, yet other locations may be utilized without limiting the scope of the apparatus 10. The handles 21 comprise an arcuate body which enables the user 15 to grasp said handles 21. Each handle 21 is preferably integrally molded into the inner platform 20 and are fabricated from plastic, yet other materials such as nylon may be utilized without limiting the scope of the apparatus 10.

The apparatus 10 also comprises a lock assembly 40 which enables the user 15 to selectively adjust the length of the apparatus 10. The lock assembly 40 comprises a spring-loaded button 41, a plurality of apertures 42, and a pair of springs 43.

Each lateral surface of the outer platform 30 comprises a plurality of apertures 42 located in a parallel orientation along a distal end which provide a receiving means to each spring-loaded button 41. Each spring-loaded button 41 is located along opposing lateral surfaces of inner platform 20. Each spring-loaded button 41 is attached to a common compression spring 43 which is attached to the inner platform 20. The spring-loaded buttons 41 are depressed as the inner platform 20 engages the outer platform 30 and is released into a desired aperture 42 which adjusts the apparatus 10 to a desired length. The lock assembly 40 is depicted herein for illustration purposes only; it is known that other means of adjusting and locking the apparatus 10 may be utilized without limiting the scope of said apparatus 10.

Figure 5:
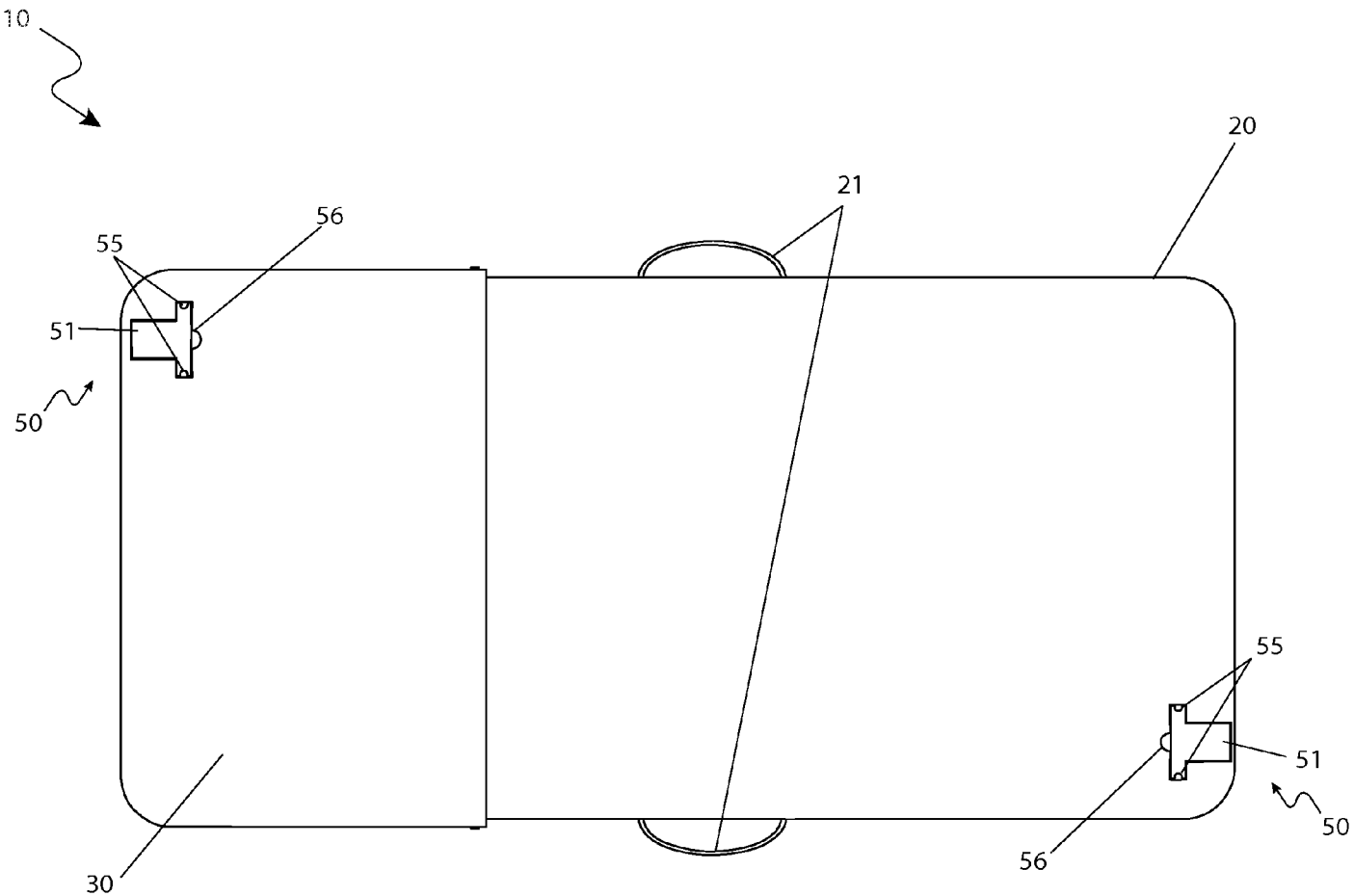
FIG. 5 is a bottom view of the portable work platform 10, according to a preferred embodiment of the present invention.
Figure 6:
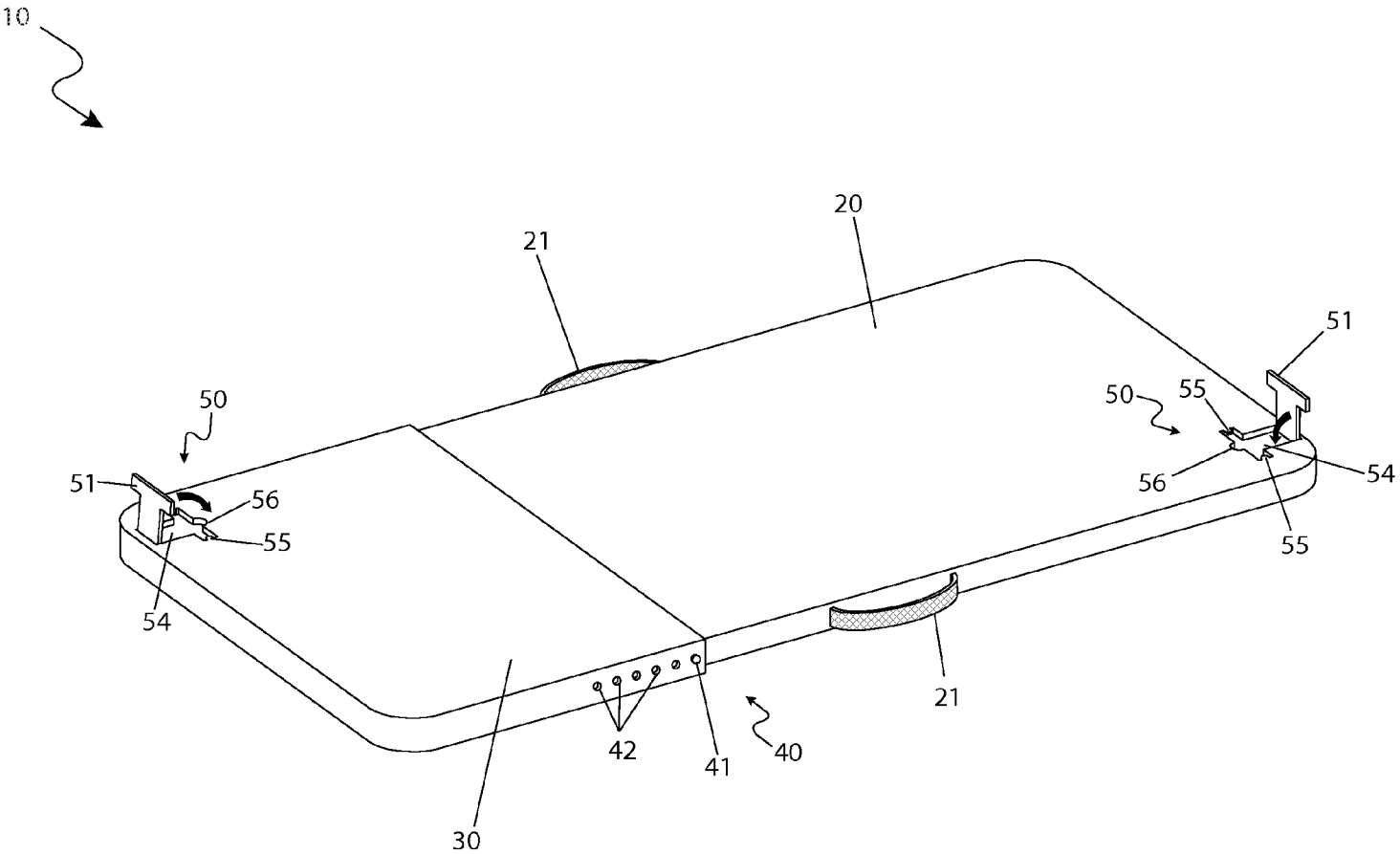
FIG. 6 is a bottom perspective view of the portable work platform 10, according to a preferred embodiment of the present invention.
Figure 7:
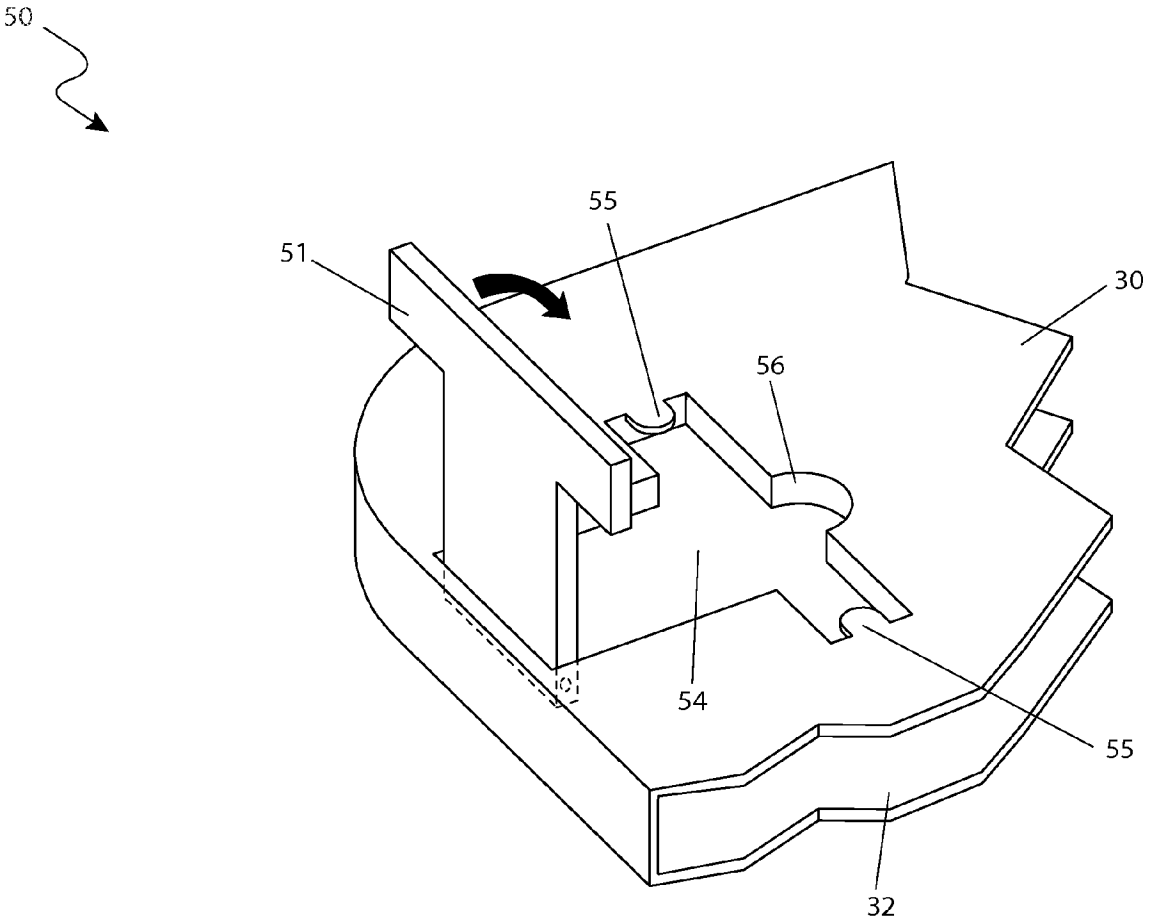
FIG. 7 is a close-up view of a support assembly 50 located on an outer platform 30, according to a preferred embodiment of the present invention; and, FIG. 8 is an exploded close-up view of the support assembly 50 located on the outer platform 30, according to a preferred embodiment of the present invention.
Figure 8:
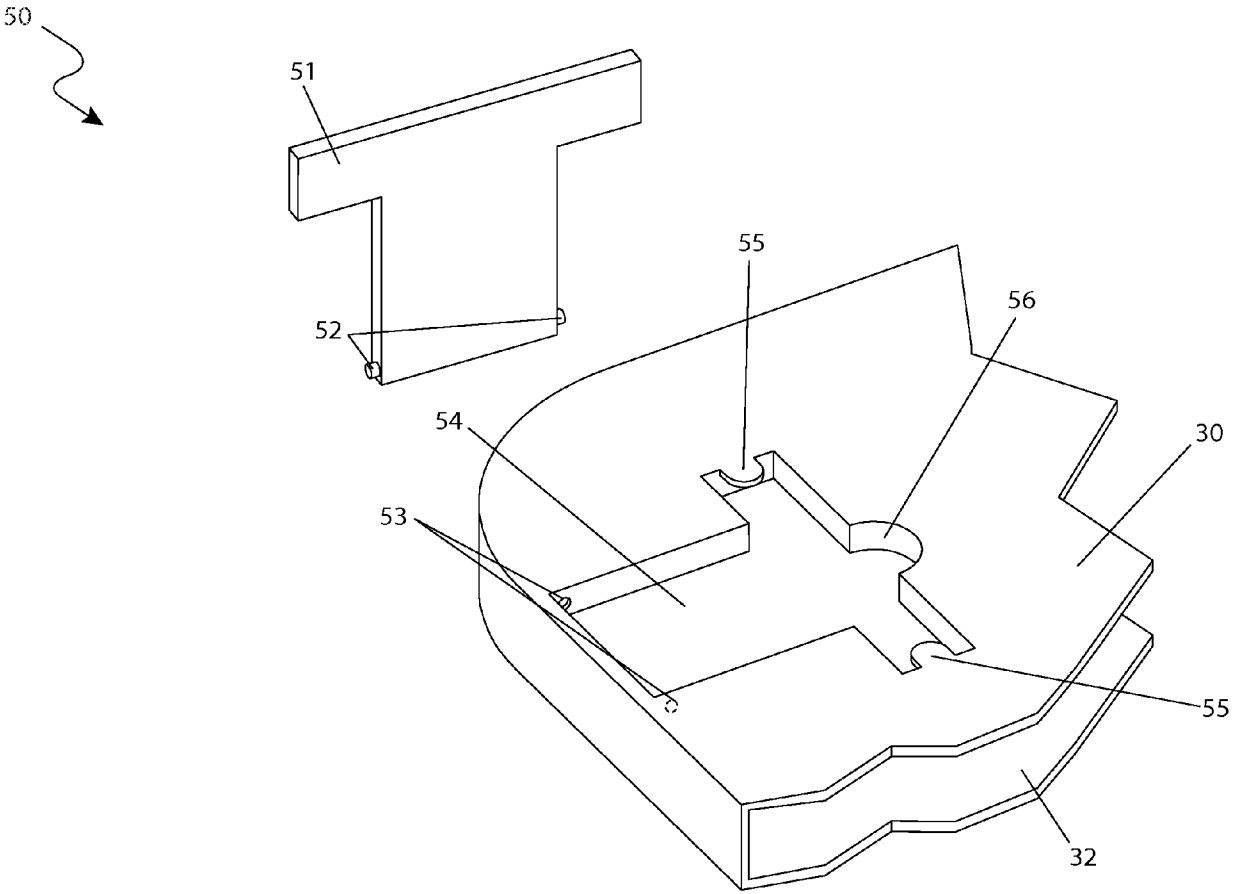

Referring now to FIG. 5, a bottom view of the apparatus 10, FIG. 6, a bottom perspective view of the of the apparatus 10, FIG. 7, is a close-up view of a support assembly 50, FIG. 8, an exploded close-up view of the support assembly 50 located on an outer platform 30, according to the preferred embodiment of the present invention, are disclosed. The apparatus 10 further comprises a pair of support assemblies 50 which provides a means to stabilize the apparatus 10 in a horizontal orientation while upon the ceiling joist 16. The support assembly 50 is located on a bottom surface of each platform 20, 30 in an opposing orientation. Each support assembly 50 comprises a stability bracket 51, a recess 54, and a finger relief 56.

The stability bracket 51 comprises a "T"-shape and is hingedly deployed from a "T"-shaped recess 54. Each recess 54 is integrally molded into each platform 20, 30. The stability bracket 51 comprises a pair of protrusions 52 located on opposing lower side surfaces which engage a detent 53 located on lower side surfaces of the recess 54 which enables the stability bracket 51 to pivot upwardly away from the recess 54 in an upright manner. The stability bracket 51 is then positioned against outer side surfaces of the ceiling joist 16, thereby prohibiting the apparatus 10 from moving horizontally during use.

When not in use the stability bracket 51 is secured into the recess 54 via a pair of securing features 55. The securing features 55 are integrally molded into the platform 20, 30 on upper portions of each recess 54 and comprise an arcuate form. The stability bracket 51 is depressed beyond each securing feature 55 and into the recess 54 via friction fitting means. The stability bracket 51 is removed from the recess 54 via a finger relief 56 which is integrally molded into each platform 20, 30 and located on an upper intermediate portion of each said recess 54. The finger reliefs 56 take on an arcuate shape which enables the user 15 to digitally remove the stability bracket 51. The user 15 inserts a finger within the finger relief 56 and applies an upward force against the stability bracket 51 which disengages said stability bracket 51 from the securing features 55 and recess 54.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring the apparatus 10; inserting the inner platform 20 into the outer platform interior portion 32 with each support assembly 50 oriented downwardly; depressing each spring-loaded button 41 and releasing said spring-loaded buttons 41 into a desired aperture 42; removing the stability brackets 51 from the recesses 54 via applying an upward force against said stability brackets 51 and disengaging from each securing feature 55 via accessing each finger relief 56; pivoting the stability bracket 51 to an upright position via enabling each protrusion 52 to rotate within each detent 53; positioning the stability brackets 51 against the ceiling joist 16; utilizing the compartments 35, 36 to store desired items; kneeling, sitting, or lying upon the upper surfaces of the platforms 20, 30, utilizing the apparatus 10 as desired; utilizing the handles 21 to transport the apparatus 10 to a desired location; and, performing work in confined spaces upon a secure base in a manner that is quick, easy, and effective.

The method of alternately installing and utilizing the apparatus 10 may be achieved by performing the following steps: acquiring the apparatus 10; inserting the inner platform 20 into the outer platform interior portion 32 with each support assembly 50 oriented downwardly; depressing each spring-loaded button 41 and releasing said spring-loaded buttons 41 into a desired aperture 42; utilizing the compartments 35, 36 to store desired items; kneeling, sitting, or lying upon the upper surfaces of the platforms 20, 30, utilizing the apparatus 10 as desired; utilizing the handles 21 to transport the apparatus 10 to a desired location; and, performing work in confined spaces upon a secure base in a manner that is quick, easy, and effective.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable work platform for supporting a user while working in confined spaces, said portable work platform comprising:
- inner and outer platforms;
- a lock assembly located at said inner and outer platforms; and,
- a plurality of support assemblies located on a bottom surface of said inner and outer platforms, each comprising:
  - a recess integrally molded into one of said inner and outer platforms;
  - a plurality of detents located within said recess;
  - a stability bracket hingedly deployed from said recess, said stability bracket including protrusions located on opposing lower side surfaces thereof, said protrusions being attached to said detents;
  - an arcuate finger relief located at an upper intermediate portion of said recess; and,
  - a plurality of arcuate securing features located at upper portions of said recess;
- wherein said lock assembly selectively locks said inner and outer platforms in a desired position;
- wherein said support assemblies stabilize said portable work platform in a horizontal orientation;
- wherein said support assemblies are pivotal relative to said inner and outer platforms;
- wherein said inner platform has a first linear medial edge extending along an entire width thereof;
- wherein said outer platform has a second linear medial edge extending along an entire width thereof;
- wherein said first linear medial edge is inserted through said second linear medial edge such that said entire width of said inner platform is disposed inside said entire width of said outer platform; and,
- wherein each of said inner and outer platforms has a solid top surface continuously extending along an entire surface area thereof, respectively.

2. The portable work platform of claim 1, wherein said inner and outer platforms include a phosphorescent additive.

3. The portable work platform of claim 1, wherein said inner platform comprises:
- a solid body;
- a plurality of first compartments integrally molded in a linear pattern parallel to a perimeter edge of said inner platform;
- a second compartment integrally molded parallel to said first compartments; and, a plurality of arcuate handles attached on opposing side surfaces of said inner platform.

4. The portable work platform of claim 1, wherein said outer platform comprises:

an interior portion;

a plurality of first compartments integrally molded in a linear pattern parallel to a perimeter edge of said outer platform; and, a second compartment integrally molded parallel to said first compartments;

wherein said outer platform receives said inner platform such that said inner platform slidably engages said interior portion of said outer platform.

5. The portable work platform of claim 1, wherein said lock assembly comprises:

a plurality of spring-loaded buttons located along opposing lateral surfaces of said inner platform;

a plurality of apertures located on a lateral surface of a distal end of said outer platform and positioned in a parallel orientation; and, a plurality of springs attached to said inner platform as well as said spring-loaded buttons respectively;

wherein said spring-loaded buttons are depressed as said inner platform engages said outer platform such that said spring-loaded buttons thereafter release into desired ones of said apertures.

6. The portable work platform of claim 1, wherein each of said recess and said stability bracket is T-shaped, wherein said stability bracket is frictionally secured into said recess by said securing features, wherein said stability bracket is removed from said recess via said finger relief.

7. The portable work platform of claim 1, wherein said stability bracket pivots upwardly away from said recess to an upright position and is thereby adapted to be positioned against outer side surfaces of a ceiling joist for prohibiting said portable work platform from moving horizontally.

8. A portable work platform for supporting a user while working in confined spaces, said portable work platform comprising:

inner and outer platforms;

a lock assembly located at said inner and outer platforms; and, a plurality of oppositely oriented support assemblies located on a bottom surface of said inner and outer platforms, each comprising:

a recess integrally molded into one of said inner and outer platforms;

a plurality of detents located within said recess;

a stability bracket hingedly deployed from said recess, said stability bracket including protrusions located on opposing lower side surfaces thereof, said protrusions being attached to said detents;

an arcuate finger relief located at an upper intermediate portion of said recess; and, a plurality of arcuate securing features located at upper portions of said recess;

wherein said lock assembly selectively locks said inner and outer platforms in a desired position and thereby adjusts a length of said portable work platform;

wherein said support assemblies stabilize said portable work platform in a horizontal orientation;

wherein said support assemblies are pivotal relative to said inner and outer platforms;

wherein said inner platform has a first linear medial edge extending along an entire width thereof;

wherein said outer platform has a second linear medial edge extending along an entire width thereof;

wherein said first linear medial edge is inserted through said second linear medial edge such that said entire width of said inner platform is disposed inside said entire width of said outer platform;

wherein each of said inner and outer platforms has a solid top surface continuously extending along an entire surface area thereof, respectively.

9. The portable work platform of claim 8, wherein said inner and outer platforms include a phosphorescent additive.

10. The portable work platform of claim 8, wherein said inner platform comprises:

a solid body;

a plurality of first compartments integrally molded in a linear pattern parallel to a perimeter edge of said inner platform;

a second compartment integrally molded parallel to said first compartments; and, a plurality of arcuate handles attached on opposing side surfaces of said inner platform.

11. The portable work platform of claim 8, wherein said outer platform comprises:

an interior portion;

a plurality of first compartments integrally molded in a linear pattern parallel to a perimeter edge of said outer platform; and, a second compartment integrally molded parallel to said first compartments;

wherein said outer platform receives said inner platform such that said inner platform slidably engages said interior portion of said outer platform.

12. The portable work platform of claim 8, wherein said lock assembly comprises:

a plurality of spring-loaded buttons located along opposing lateral surfaces of said inner platform;

a plurality of apertures located on a lateral surface of a distal end of said outer platform and positioned in a parallel orientation; and, a plurality of springs attached to said inner platform as well as said spring-loaded buttons respectively;

wherein said spring-loaded buttons are depressed as said inner platform engages said outer platform such that said spring-loaded buttons thereafter release into desired ones of said apertures.

13. The portable work platform of claim 8, wherein each of said recess and said stability bracket is T-shaped, wherein said stability bracket is frictionally secured into said recess by said securing features, wherein said stability bracket is removed from said recess via said finger relief.

14. The portable work platform of claim 8, wherein said stability bracket pivots upwardly away from said recess to an upright position and is thereby adapted to be positioned against outer side surfaces of a ceiling joist for prohibiting said portable work platform from moving horizontally.

15. A method of utilizing a portable work platform for supporting a user while working in confined spaces, said method comprising the steps of:

providing inner and outer platforms;

providing and locating a lock assembly at said inner and outer platforms;

providing and oppositely orienting a plurality of support assemblies on a bottom surface of said inner and outer platforms, each comprising:

a recess integrally molded into one of said inner and outer platforms;

a plurality of detents located within said recess;

a stability bracket hingedly deployed from said recess, said stability bracket including protrusions located on opposing lower side surfaces thereof, said protrusions being attached to said detents;

an arcuate finger relief located at an upper intermediate portion of said recess; and, a plurality of arcuate securing features located at upper portions of said recess;

adjusting a length of said portable work platform by causing said lock assembly to selectively lock said inner and outer platforms in a desired position; and, said support assemblies stabilizing said portable work platform in a horizontal orientation;

wherein said support assemblies are pivotal relative to said inner and outer platforms;

wherein said inner platform has a first linear medial edge extending along an entire width thereof;

wherein said outer platform has a second linear medial edge extending along an entire width thereof;

wherein said first linear medial edge is inserted through said second linear medial edge such that said entire width of said inner platform is disposed inside said entire width of said outer platform;

wherein each of said inner and outer platforms has a solid top surface continuously extending along an entire surface area thereof, respectively.

* * * * *